US007865291B2

(12) United States Patent
Müller

(10) Patent No.: US 7,865,291 B2
(45) Date of Patent: Jan. 4, 2011

(54) SYSTEM AND METHOD FOR A VOLUMETRIC EFFICIENCY MODEL FOR ALL AIR INDUCTION CONFIGURATIONS

(75) Inventor: Martin Müller, Ann Arbor, MI (US)

(73) Assignee: Delphi Technologies, Inc., Troy, MI (US)

( * ) Notice: Subject to any disclaimer, the term of this patent is extended or adjusted under 35 U.S.C. 154(b) by 131 days.

(21) Appl. No.: 11/948,297

(22) Filed: Nov. 30, 2007

(65) Prior Publication Data

US 2009/0018753 A1 Jan. 15, 2009

Related U.S. Application Data

(60) Provisional application No. 60/949,269, filed on Jul. 12, 2007.

(51) Int. Cl.
*F02D 41/26* (2006.01)
*F02D 41/38* (2006.01)

(52) U.S. Cl. ..... 701/103; 123/676; 123/681

(58) Field of Classification Search ..... 701/103–105, 701/108, 54; 123/465, 676, 681, 684, 568.11–568.28, 123/325, 399
See application file for complete search history.

(56) References Cited

U.S. PATENT DOCUMENTS 4,404,946 A * 9/1983 Hoard et al. ..... 123/486
5,357,932 A * 10/1994 Clinton et al. ..... 123/488
6,250,292 B1 * 6/2001 Suhre ..... 123/688
6,393,903 B1 5/2002 Reed et al.
6,636,796 B2 * 10/2003 Kolmanovsky et al. ..... 701/104
6,758,198 B1 * 7/2004 Suhre et al. ..... 123/585
6,820,600 B1 * 11/2004 Sisken et al. ..... 123/568.21
6,837,227 B2 * 1/2005 Jaliwala et al. ..... 123/568.21
7,181,332 B1 * 2/2007 Vick et al. ..... 701/103
2002/0107630 A1 * 8/2002 Yagi ..... 701/102
2008/0098734 A1 * 5/2008 Olsson ..... 60/605.1
2008/0127938 A1 * 6/2008 Hagari ..... 123/439

OTHER PUBLICATIONS

MAP Sensor internet search: http://www.sai-inspection.com/map_sensor.htm.*

* cited by examiner

*Primary Examiner*—Stephen K Cronin
*Assistant Examiner*—Johnny H Hoang
(74) *Attorney, Agent, or Firm*—Thomas N. Twomey

(57) ABSTRACT

A system and method for controlling an engine involves providing a model for volumetric efficiency. The model recognizes that volumetric efficiency (VE) has stronger dependency on intake pressure than on exhaust pressure. The model allows tuning of the relative importance of intake pressure to exhaust pressure, specifically, by reducing the relative importance of the exhaust pressure to intake pressure in the composite volumetric efficiency load variable. The model provides for a calculation where the exhaust pressure term of the engine pressure ratio is de-rated through the use of an exponent less than one.

11 Claims, 4 Drawing Sheets

SYSTEM AND METHOD FOR A VOLUMETRIC EFFICIENCY MODEL FOR ALL AIR INDUCTION CONFIGURATIONS

RELATED APPLICATIONS

This application claims the benefit of U.S. provisional application Ser. No. 60/949,269 filed Jul. 12, 2007 entitled PUMPING TORQUE ESTIMATION MODEL FOR ALL AIR INDUCTION CONFIGURATIONS AND VOLUMETRIC EFFICIENCY MODEL FOR ALL AIR INDUCTION CONFIGURATIONS, owned by the common assignee of the present invention and herein incorporated by reference in its entirety.

TECHNICAL FIELD

The present invention relates to a system and method for a volumetric efficiency model suitable for use with all air configurations (e.g., naturally-aspirated, turbo-charged, and super-charged).

BACKGROUND OF THE INVENTION

It is known that in an internal combustion engine, a combustion charge of fuel and air is drawn into the combustion chamber (cylinder) through one or more intake valves. After combustion, the resulting burned gases are exhausted from the cylinder through one or more exhaust valves. The measure of how efficiently the engine can move the air/fuel charge into and out of the cylinder is referred to as the volumetric efficiency (VE). The VE is usually expressed as a percentage, and describes the volume of air charge that actually enters the cylinder during induction as compared to the cylinder volume. For control of the engine air/fuel ratio, an electronic engine controller or the like needs to have an estimate of the VE so that it can generate an accurate estimation of the mass airflow entering the combustion chamber. Conventional approaches estimate the VE as a function of engine speed and an engine pressure ratio (i.e., exhaust pressure/intake pressure). The engine pressure ratio is used as a load dependency in the VE calculation since this is widely thought to effectively combine the boundary conditions of relevance on volumetric efficiency while including altitude dependency.

However, engine pressure ratio does not change monotonically with engine load for a turbo-charged engine, and is therefore not a suitable model form for all air induction configurations.

There is therefore a need for a system and method for a volumetric efficiency model that minimizes or eliminates one or more of the problems set forth above.

SUMMARY OF THE INVENTION

The present invention is directed to a system and method for determining a volumetric efficiency (VE) of an internal combustion engine that has a VE model that will work with any one of a number of air induction configurations (e.g., naturally-aspirated (NA), turbo-charged (TC), super-charged (SC) and comparable air induction configurations). The invention recognizes that volumetric efficiency (VE) has a stronger dependency on the intake pressure than on the exhaust pressure. The model allows tuning of the relative importance of intake pressure to exhaust pressure, specifically, by reducing the relative importance of the exhaust pressure to intake pressure in the composite volumetric efficiency load variable. This model is not only more physically correct, but also solves the non-monotonicity problem described in the Background.

The method includes a number of steps. The first step involves determining an engine exhaust pressure term. The next step involves de-rating the exhaust pressure term in accordance with predetermined criteria. This step is included to reflect the need to deemphasize the importance of the exhaust pressure term to reflect the appropriate load dependency, as mentioned above. The next step involves determining an intake pressure term, and thereafter determining an engine pressure ratio of the de-rated exhaust pressure term to the intake pressure term. Finally, the last step involves determining a volumetric efficiency (VE) using the now-determined engine pressure ratio. In an alternate embodiment, a method of controlling an engine is provided, and includes the further step of controlling the engine based on the newly-determined VE.

The de-rating step may include the sub-steps of establishing an exponent, and then raising the exhaust pressure term to the power of that exponent, where the exponent is less than 1 so as to deemphasize the exhaust pressure term relative to the intake pressure term.

Other features, object and advantages of the present invention are also presented.

BRIEF DESCRIPTION OF THE DRAWINGS

The present invention will now be described by way of example, with reference to the accompanying drawings.

DETAILED DESCRIPTION OF THE PREFERRED EMBODIMENT

Figure 1:
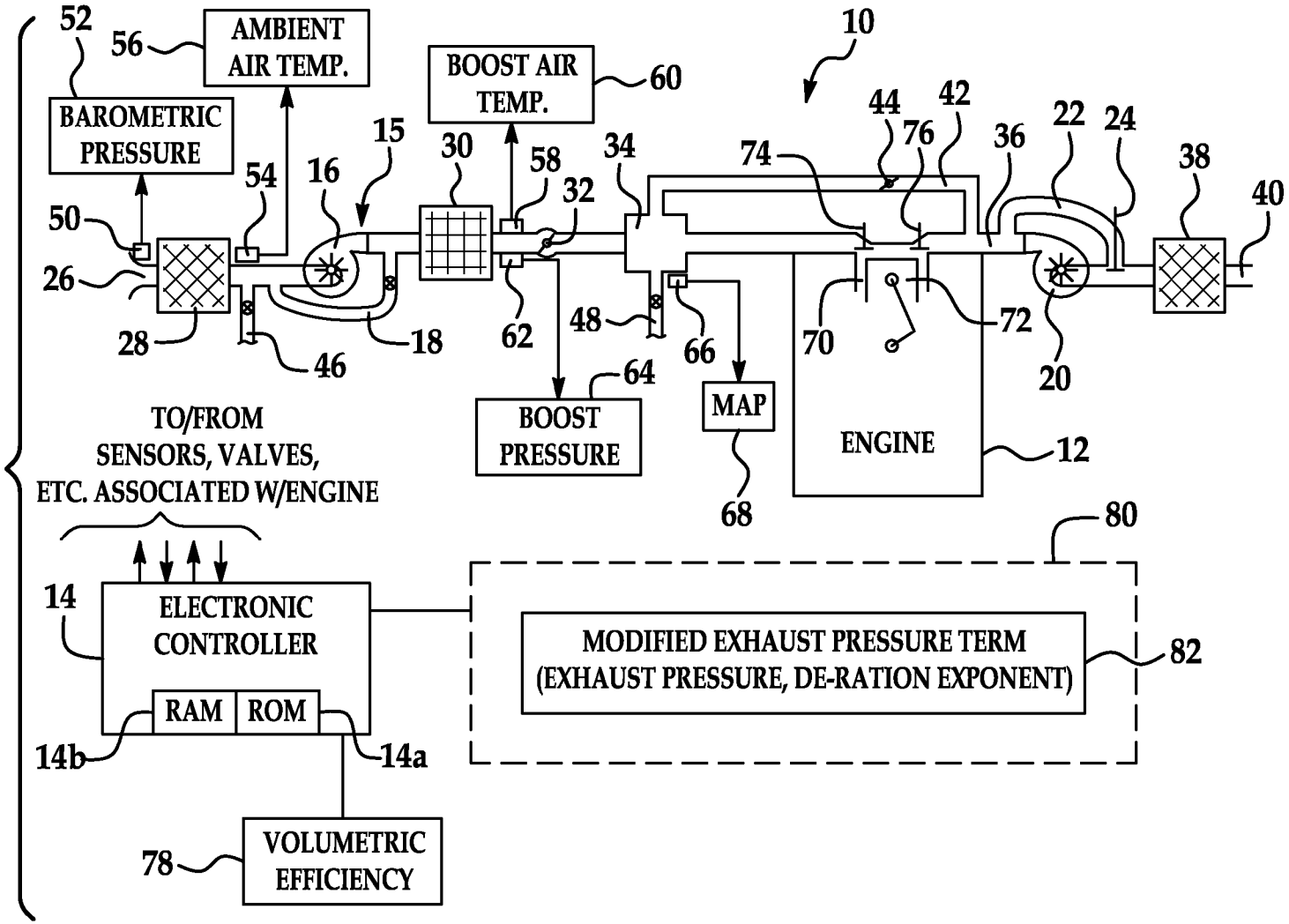
FIG. 1 is simplified diagrammatic and block diagram of a turbo-charged engine system having a controller configured to model volumetric efficiency according to the invention.

Referring now to the drawings wherein like reference numerals are used to identify identical components in the various views, FIG. 1 is a diagrammatic view of a turbo-charged internal combustion engine system 10 configured in accordance with the present invention. The system 10 includes an internal combustion engine 12 controlled by an electronic engine controller 14. Engine 12 may be a spark-ignition engine that includes a number of base engine components, sensing devices, output systems and devices, and a control system. Alternatively, the present invention may be used with compression-ignition engines, such as diesel or the like.

Generally, electronic controller 14 is configured via suitable programming to contain various software algorithms and calibrations, electrically connected and responsive to a plurality of engine and vehicle sensors, and operably connected to a plurality of output devices. Controller 14 includes at least one microprocessor or other processing unit, associated memory devices such as read only memory (ROM) 14*a* and random access memory (RAM) 14*b*, input devices for monitoring input from external analog and digital devices, and output drivers for controlling output devices. In general, controller 14 is operable to monitor engine operating conditions and operator inputs using the plurality of sensors, and control engine operations with the plurality of output systems and actuators, using pre-established algorithms and calibrations that integrate information from monitored conditions and inputs. The software algorithms and calibrations which are executed in electronic controller 14 may generally comprise conventional strategies known to those of ordinary skill in the art. The software algorithms and calibrations are preferably embodied in pre-programmed data stored for use by controller 14. Overall, in response to the various inputs, the controller 14 develops the necessary outputs to control the throttle, fuel, spark, EGR and other aspects, all as known in the art.

System 10 further includes, in the illustrated embodiment, a turbo-charger 15 having a compressor 16, which may include a compressor recirculation path 18, and an exhaust gas driven turbine 20, which includes a parallel waste-gate flow path 22. As known, the compressor is driven by the turbine, and the amount of boost is controlled principally by a waste-gate control mechanism (e.g., valve) shown schematically as a waste-gate valve 24. The present invention, however, is not limited to a turbo-charged engine embodiment, and is applicable to all air induction configurations, namely, naturally-aspirated (NA), turbo-charged (TC), supercharged (SC) engine and other comparable air induction configurations now known or hereafter developed.

On the air intake side of the engine 12, FIG. 1 shows an air intake port 26, an air filter 28, an intercooler 30 configured to cooperate with and complement compressor 16, a throttle valve 32, and an intake manifold 34. These features are well known and understood in the art. These features may comprise conventional implementations.

On the exhaust side of the engine 12, FIG. 1 shows an exhaust gas manifold 36. Additionally, various downstream exhaust components are conventionally included in system 10, such as a catalytic converter and a muffler, and are shown schematically as a single exhaust restriction block 38, which feeds into exhaust gas outlet 40. These features are well known and understood in the art. These features may comprise conventional implementations.

Conventionally, a variety of feedback paths are provided in system 10. For example, FIG. 1 shows an exhaust gas recirculation (EGR) tube or the like coupled between the exhaust manifold 36 and the intake manifold 34, and whose flow path is adjusted by way of an EGR valve 44. As known, the EGR valve 44 may be controlled by the electronic controller 14 in accordance with conventional EGR algorithms configured to achieve predetermined performance criteria. Generally, varying the position of the valve 44 alters the amount of exhaust gas that is provided to the intake manifold 34 for mixing with intake air, fuel and the like destined for combustion in engine 12.

With continued reference to FIG. 1, additional feeds may also be provided. For example, evaporative emissions control and diagnostics generally call for an evaporative ("evap") emissions canister (not shown) be provided in an automotive vehicle that includes system 10. The evap canister is coupled to a fuel tank (not shown) as well as to inlets 46 and 48 by a combination of vent, purge and check valves, all as known in the art.

FIG. 1 also shows a variety of sensors deployed on the intake side of the engine 12, including an ambient or barometric pressure sensor 50 configured to produce a barometric pressure signal 52, an ambient air temperature sensor such as an intake air temperature (IAT) sensor 54 configured to generate an IAT signal 56, a boost air temperature sensor 58 configured to generate a boost air temperature signal 60, a boost pressure sensor 62 configured to generate a boost pressure signal 64, and an intake manifold pressure sensor such as a manifold absolute pressure (MAP) sensor 66 configured to generate a MAP signal 68. These sensors and their functioning are all well known and understood in the art. These sensors may all comprise conventional components.

Additionally, system 10 includes capabilities for determining a value for the mass air flow $\dot{m}_C$, which may be obtained either via measurement by an air meter (e.g., mass air flow sensor or MAF sensor-not shown) typically placed just upstream of the compressor 16, or, in an alternate embodiment, calculated by the well known speed-density equation, for example as set forth in U.S. Pat. No. 6,393,903 entitled VOLUMETRIC EFFICIENCY COMPENSATION FOR DUAL INDEPENDENT CONTINUOUSLY VARIABLE CAM PHASING to Reed et al., assigned to the common assignee of the present invention, and incorporated herein by reference in its entirety.

Additionally, the engine 12 typically includes a plurality of cylinders 70, one of which is shown (side view) in FIG. 1. In very general terms, a respective piston 72 is disposed in each cylinder 70, as known, and is arranged to reciprocate therein, imparting a torque for rotation of a crankshaft (not shown). As the piston 72 reciprocates within cylinder 70 in accord with a 4-stroke cycle, a fresh air and fuel charge is drawn into the combustion cylinder during an intake stroke through an intake valve(s) 74 and is exhausted during an exhaust stroke through an exhaust valve(s) 76.

As further known, the electronic engine controller 14 is configured to determine a volumetric efficiency (VE) of the engine, which is shown in block form as block 78 in FIG. 1. The controller 14 is configured to take the calculated VE 78 (and other information) into account when controlling the air/fuel ratio of the engine system 10, as described in the Background.

The electronic controller 14 is configured to use a new model 80 for estimating an engine pressure ratio to be used for calculating VE 78 that is suitable for all air induction configurations under a wide operating range. A model 80 is provided for estimating the VE 78, which in turn includes a mechanism for calculating an improved engine pressure ratio that employs, in the illustrated embodiment, a modified exhaust pressure term look-up table 82. In general, the table 82 includes data reflecting a de-emphasis on the exhaust pressure term in accordance with predetermined criteria. More specifically and as will be described in greater detail below, an initially-calculated value for the exhaust pressure term is raised to the power of an exponent that may be less than or equal to one (1), but that is preferably is less than one (1). The result is that the mechanism determines the engine pressure ratio using a deemphasized (lesser value) exhaust pressure term, which more accurately reflects the VE's greater dependency on the intake pressure. It should be emphasized that while a data table 82 is described and illustrated for an embodiment of the invention, the invention is not so limited. A data table 82 is preferred in real-time embodiments due to practical processing resource limitations of the controller 14. However, this is based on present-day computing capabilities, cost limitations, etc., as known to those in the art. It is contemplated that other implementations are possible, for example, direct implementations of the model provided sufficient computing resources are available (e.g., direct implementation of raising a value to the power of de-ration exponent described above).

Additionally, throughout the specification, it may be alternatively stated that the exponent may be less than or equal to one, on the one hand, or simply less than one, on the other hand. The de-rating functionality of the present invention is obtained only when the exponent is less than one. When the exponent is equal to one, the inventive model simplifies into the conventional engine pressure ratio where exhaust and intake pressure terms are given equal weight. And while the scenario where the exponent is equal to one reflects the conventional pressure ratio, the model defined by the present invention provides practical advantages in commercial embodiments where backwards compatibility is desired. That is, the single model according to the invention can be used in commercial embodiments, and where backwards compatibility is desired through the use of the conventional engine pressure ratio, the exponent can simply be set equal to one.

A method for controlling an engine using the new model for estimating VE will be described herein. However, before proceeding to this description, a more detailed treatment of the technical aspects involved is believed to be beneficial and thus warranted.

As described in the Background, the existing VE load dependency, engine pressure ratio $Pr_{eng}^{tot}$ ($Pr1=P_{exh}/P_{int}$), known in the art does not work for an active waste-gate turbo charged engine. This is because there is not a unique relationship between load and engine pressure ratio inasmuch as the $Pr_{eng}^{tot}$ reaches a global minimum at the lowest wide-open-throttle (WOT) load and thereafter increases for further load increases.

Figure 2:
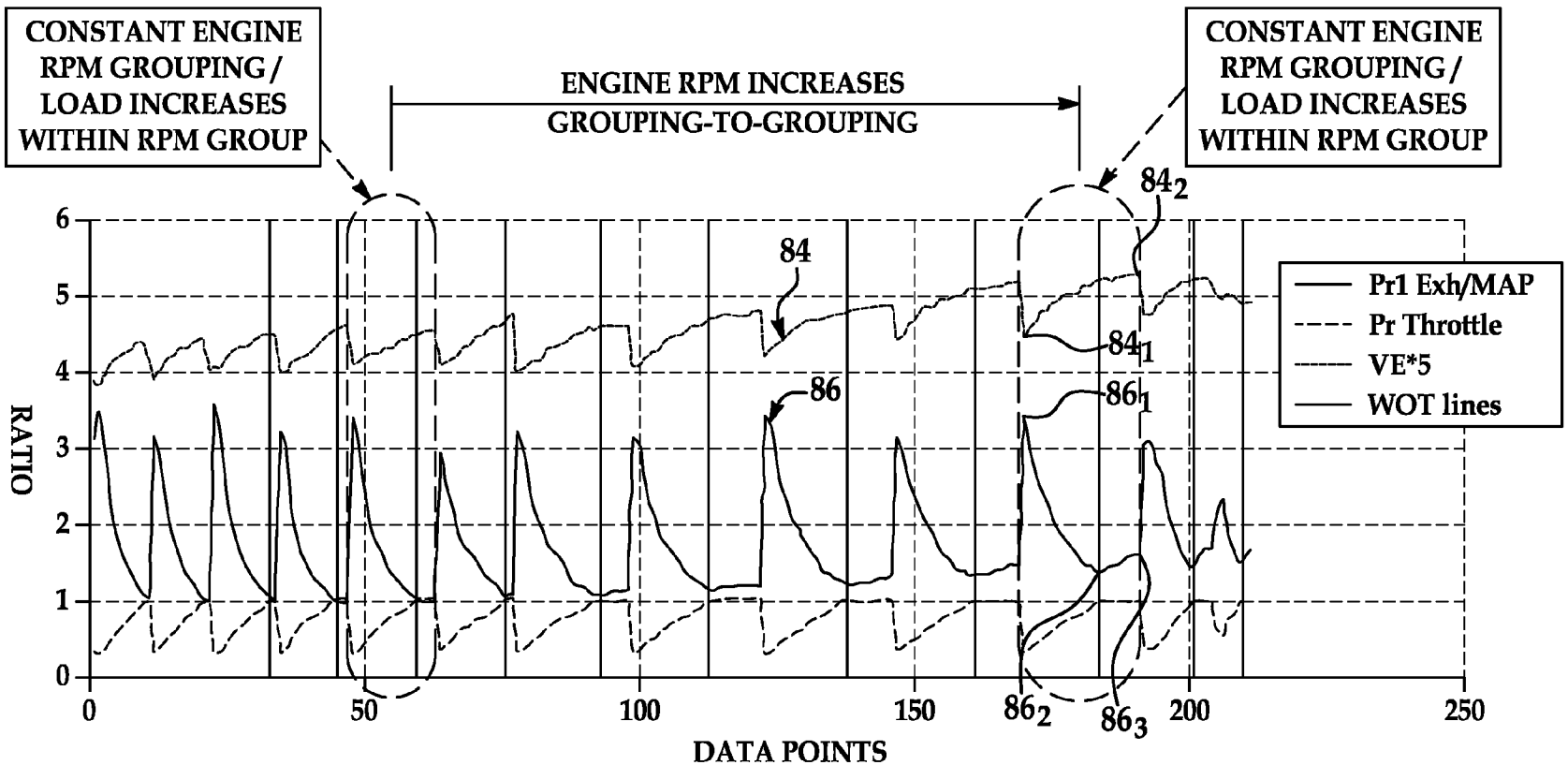
FIG. 2 is a chart showing volumetric efficiency plotted with engine pressure ratio showing the shortcomings of the conventional engine pressure ratio for one air induction configuration.

FIG. 2 is a chart illustrating this proposition. FIG. 2 shows a plurality of constant engine speed (rpm) groupings, two of which—a low-speed grouping at the left and a high-speed grouping at the right—are enclosed in phantom-lines. The engine speed of any grouping increase as one moves left-to-right. Within each constant engine speed group, the load increases left-to-right. Through the foregoing, a complete range of engine speed and load are illustrated. With this description in mind, FIG. 2 shows volumetric efficiency (trace 84) plotted with a conventional engine pressure ratio (i.e., $P_{exh}/P_{int}$, trace 86) for a turbo-charged engine configuration with an active waste gate. The volumetric efficiency increases monotonically with increasing load as shown for example between points $\mathbf{84}_1$ and $\mathbf{84}_2$. The engine pressure ratio decreases with increasing load until the lowest load with wide open throttle (WOT) is reached. This is most evident at the higher engine speeds (i.e., higher engine speed groupings), for example, as shown between points $\mathbf{86}_1$ and $\mathbf{86}_2$. However, the engine pressure ratio then begins to increase for further increases in the load, as shown between points $\mathbf{86}_2$ and $\mathbf{86}_3$. In view of this, use of the conventional VE model load dependency of $Pr_{eng}^{tot}$ ($Pr1=P_{exh}/P_{int}$) will not work for an active waste-gate turbo-charged engine because there is not a unique relationship between load and engine pressure.

One object of the present invention is to define a load dependency that both (1) reasonably combines the effect of intake and exhaust pressure into one variable and (2) is suitable for real-time implementation (e.g., suitable for use in software that can be executed on controller 14).

As background, the reason MAP is not used as a VE load variable is because it does not take into account the effect that throttling has on VE, which results in incorrect VE modeling at altitude. Instead, an engine was thought analogous to a nozzle and the pressure ratio was introduced as the load variable. Since the engine pressure ratio includes the exhaust manifold pressure estimate, which is proportional to the barometric pressure, altitude compensation was achieved, and experience with naturally aspirated engines at altitude has not disagreed. However, the engine-nozzle analogy described by a single pressure ratio is now found to be an over-simplification in the case of the turbo charged engine with active wastegate.

The reasons that VE changes with load are the same reasons the residual gas concentration changes with load, namely, because of back flow ($\dot{m}_{BackFlow}^{tot}$), as shown in equation (1).

$$VE \alpha 1/\dot{m}_{BackFlow}^{tot} \tag{1}$$

The main contributors to the total back flow ($\dot{m}_{BackFlow}^{tot}$) include (1) back flow from the cylinder back into the intake manifold during the early part of the intake valve open period ($\dot{m}_{BackFlow}^{Cyl2Int}$) and (2) back flow from the exhaust manifold back into the cylinder ($\dot{m}_{BackFlow}^{Exh2Cyl}$). Additionally, negative scavenging may occur especially for large overlap cam timing where the exhaust manifold pressure causes back flow into the cylinder and onwards into the intake manifold. The total back flow (mass flow rate) is shown in equation (2).

$$\dot{m}_{BackFlow}^{tot}=\dot{m}_{BackFlow}^{Cyl2Int}+\dot{m}_{BackFlow}^{Exh2Cyl} \tag{2}$$

The pressure ratios responsible for these back-flow contributions are shown in equation (3):

$$\dot{m}_{BackFlow}^{Cyl2Int} \propto Pr^{Cyl2Int} \cong \frac{P_{Cyl}^{@IVO}}{P_{IntMnfd}}, \quad \dot{m}_{BackFlow}^{Exh2Cyl} \propto Pr^{Exh2Cyl} \cong \frac{P_{ExhMnfd}}{P_{Cyl}^{@IVO}} \tag{3}$$

This shows why it was natural to apply the convenient assumption that the total back flow amount can be described by $Pr_{eng}^{tot}$ dependency since equation (4) shows:

$$Pr_{eng}^{tot} = Pr^{Ctl2Int} * Pr^{Exh2Cyl} = \frac{P_{Cyl}^{@IVO}}{P_{IntMnfd}} * \frac{P_{ExhMnfd}}{P_{Cyl}^{@IVO}} = \frac{P_{ExhMnfd}}{P_{IntMfd}} \tag{4}$$

This simplification is, however, only reasonable if the proportionality factor between pressure ratio and back-flow for Cyl2Int and Exh2Cyl are comparable.

Additional investigation, including simulation, however, supports the proposition that the dependence of VE on the intake pressure is significantly stronger than on exhaust pressure. And despite the variations one may observe in the intake and exhaust pressures, the data show that the VE will increase with load, even in the boosted range of a turbo-charged engine configuration. The model 80 of the present invention reflects these two considerations.

More particularly, for equation (3), the cylinder pressure relevant for the individual backflow contributions is approximated as $P_{Cyl}^{@IVO}$. However, this pressure is not known, and in any event changes with load. A reasonable approximation for an engine with no exhaust resistance is barometric pressure (Baro). Therefore, a reasonable alternative load variable for VE is a new, modified engine pressure ratio (Pr2), as set forth in equation (5).

$$Pr2 = \frac{\left(\frac{P_{ExhMnfd}}{Baro}\right)^a}{\left(\frac{P_{IntMnfd}}{Baro}\right)} \text{ where } a <= 1 \tag{5}$$

The variable a is the exponent for selectively deemphasizing the exhaust pressure term. As described, this model for VE, which is predicated on equation (5), is particularly suited for all air induction configurations. When selecting a<1, VE is given less dependence on exhaust pressure relative to the intake pressure. This selection is particularly suited for turbo-charged engine configurations with an active waste gate. Moreover, note that when selecting a=1 ➔Pr2=Pr1 and the model becomes backward compatible.

Equation (5) shows one method of de-rating the effect on VE of exhaust pressure relative to intake pressure, and reasons were giving in the above as to the deduction of this model form. However, there are many other model forms that also achieve the de-rating of the exhaust pressure importance relative to intake pressure. Equation (6) provides an alternative form:

$$Pr2 = \frac{(P_{ExhMnfd})^a}{(P_{IntMnfd})} \text{ where } a <= 1 \tag{6}$$

The importance is therefore in the concept of de-rating the importance of exhaust pressure relative to intake pressure as they affect volumetric efficiency, thus achieving a load dependency with monotonic behavior which is also better physically descriptive.

Figure 3:
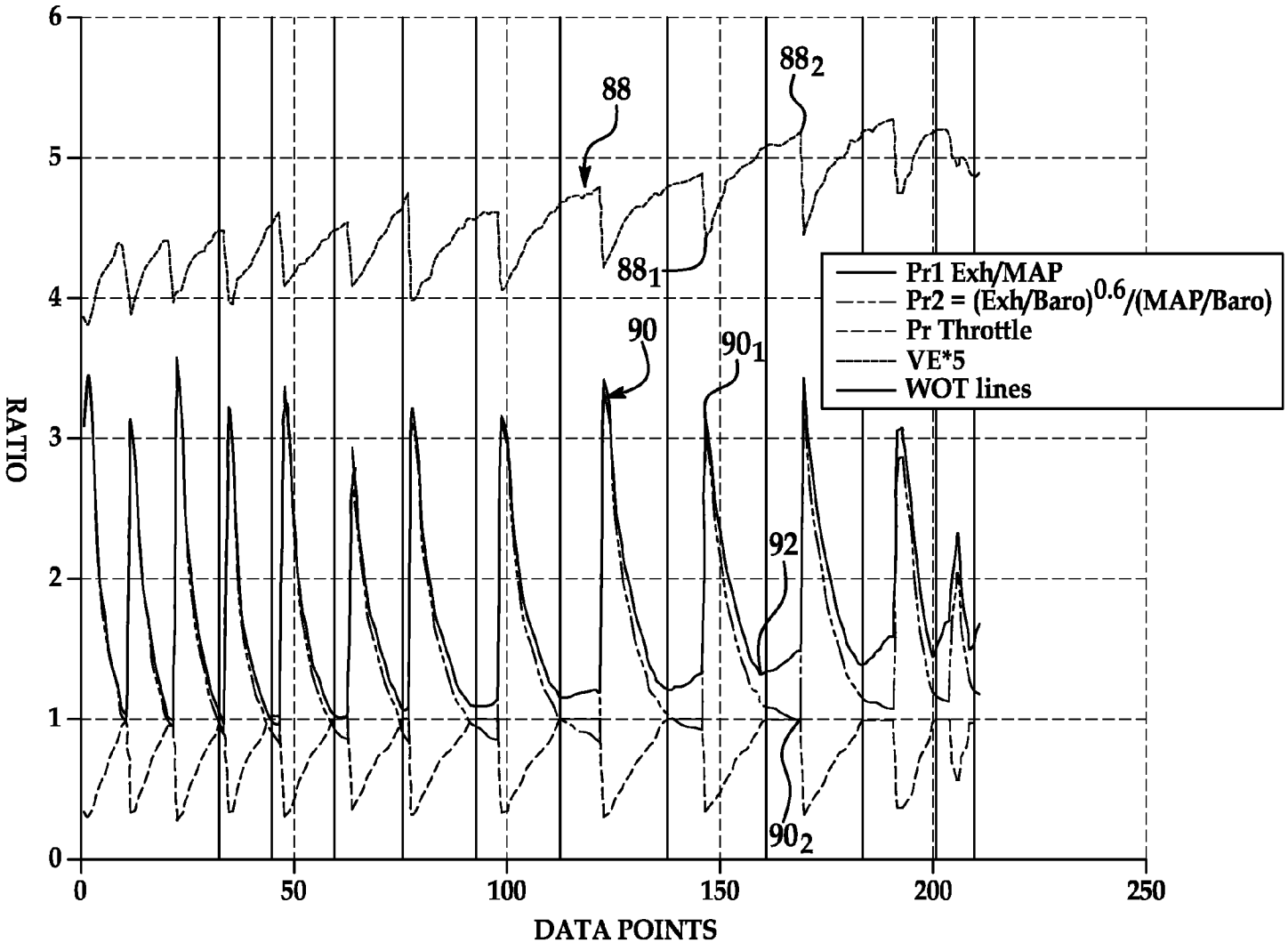
FIG. 3 is a chart showing volumetric efficiency plotted with engine pressure ratio determined in accordance with the present invention.

FIG. 3 is a chart similar to FIG. 2 showing the improvement of the present invention in achieving correspondence between increasing VE, on the one hand, and increasing load/decreasing load dependency Pr2 on the other hand. In FIG. 3, the trace 88 generally illustrates the volumetric efficiency (VE) and trace 90 illustrates the new engine pressure ratio Pr2 defined in equation (5) for an exponent of a=0.6. As described above, the VE increases generally with load, as for example between points $\mathbf{88}_1$ and $\mathbf{88}_2$. FIG. 3 also shows that the new engine pressure ratio Pr2 decreases monotonically throughout the load range for the active waste-gate turbo charged engine. See for example, the trace 90 between points $\mathbf{90}_1$ and $\mathbf{90}_2$. For frame of reference, the conventional definition of engine pressure ratio Pr1 is also shown, and the inflection point near a WOT is indicated at point 92.

The new model for VE, calculated using the improved engine pressure ratio, will therefore work from a pragmatic point of view for existing engine management system (EMS) control logic (i.e., reduced level of changes needed). It is also noted that the new pressure ratio definition is very similar to the traditional for low loads and the divergence increases with load.

Figure 4:
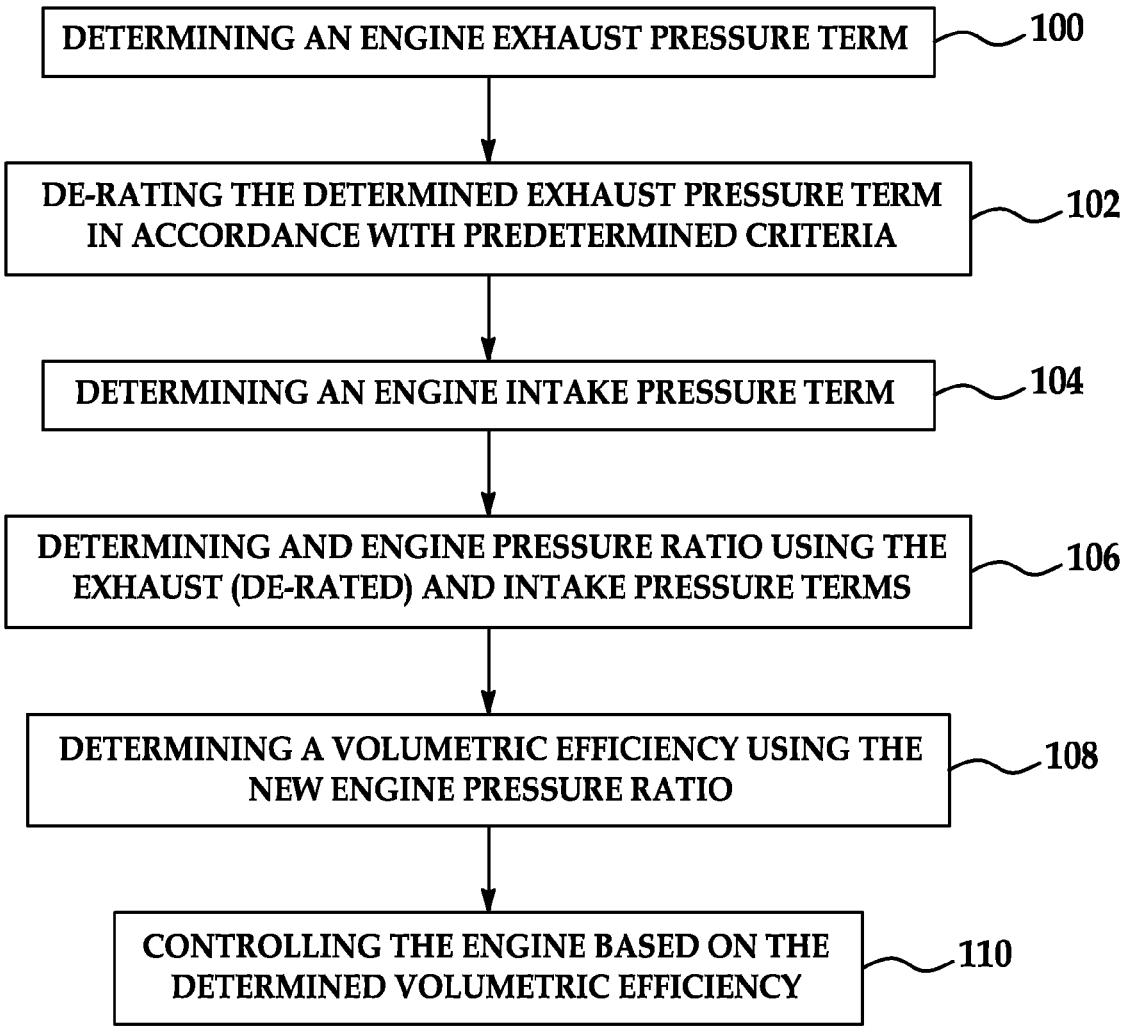
FIG. 4 is a flowchart showing a method of controlling an engine which involves a determining the volumetric efficiency according to the invention.

FIG. 4 is a flowchart diagram illustrating a method of controlling an engine using the new VE model. The method begins in step 100. It should be understood that in the embodiment of FIG. 1, the controller 14 is configured, through programming, to implement the model 80 and to perform the described method.

In step 100, the controller 14 is configured to determine an engine exhaust pressure term. As indicated in equation (5), a suitable exhaust pressure term may be the exhaust manifold pressure divided by the barometric pressure, namely, $$\frac{P_{ExhMnfd}}{Baro}.$$

The exhaust manifold pressure ($P_{ExhMnfd}$) may be obtained through suitable, conventional models, and the barometric pressure may be obtained from a measured reading of the barometric pressure signal 52 or where possible estimated. The method then proceeds to step 102.

In step 102, the controller 14 is configured to derate or otherwise deemphasize the exhaust pressure term relative to the intake pressure term. This is due to the VE's stronger dependence on the intake pressure as a load dependency (as described above) as compared to the exhaust pressure. In one embodiment, the derating function is performed by establishing an exponent that is less than one and then raising the exhaust pressure term to the power of the established exponent, namely, $$\left(\frac{P_{ExhMnfd}}{Baro}\right)^a.$$

In one embodiment, an exponent value of 0.60 was found adequate for a turbo-charged (active waste gate) engine configuration. A look-up table, such as the look-up table 82, may be used to implement this step. Table 1 shows an exemplary implementation for the table 82, where the exhaust pressure ratio term $$\frac{P_{ExhMnfd}}{Baro}$$

and the exponent a<=1 are provided as inputs to the table 82, which returns a numeric value to be further used in further processing. In practice, the exponent may be selected by determining the largest value for the exponent that ensures sufficiently monotonically decreasing pressure ratio Pr2 with increasing load (as evaluated per equation (5)). In this regard, Table 1 shows an exemplary range of 0.4 to 1.0 for the exponent, although as indicated above, the actual value for the exponent is dependent on the engine system being assessed. For a turbo-charged engine, the exponent will be <1 for an active waste-gate configuration. While this selection (<1) may not be required for a passive waste-gate confirmation at sea level, testing should be performed at altitude to determine whether or not an exponent less than one (<1) is warranted. The method then proceeds to step 104.

TABLE 1

| | Exponent a | | | | | | |
|---|---|---|---|---|---|---|---|
| | 0.4 | 0.5 | 0.6 | 0.7 | 0.8 | 0.9 | 1 |
| 1 | 1 | 1 | 1 | 1 | 1 | 1 | 1 |
| 1.2 | 1.075654 | 1.095445 | 1.115601 | 1.136127 | 1.157031 | 1.17832 | 1.2 |
| 1.4 | 1.144066 | 1.183216 | 1.223705 | 1.26558 | 1.308888 | 1.353678 | 1.4 |

TABLE 1-continued

| | Exponent a | | | | | | |
|---|---|---|---|---|---|---|---|
| | 0.4 | 0.5 | 0.6 | 0.7 | 0.8 | 0.9 | 1 |
| 1.7 | 1.236459 | 1.30384 | 1.374894 | 1.449821 | 1.52883 | 1.612145 | 1.7 |
| 2 | 1.319508 | 1.414214 | 1.515717 | 1.624505 | 1.741101 | 1.866066 | 2 |
| 2.4 | 1.419334 | 1.549193 | 1.690934 | 1.845644 | 2.014508 | 2.198822 | 2.4 |
| 2.9 | 1.530944 | 1.702939 | 1.894257 | 2.107068 | 2.343788 | 2.607103 | 2.9 |
| 3.5 | 1.650544 | 1.870829 | 2.120512 | 2.403519 | 2.724297 | 3.087886 | 3.5 |
| 4 | 1.741101 | 2 | 2.297397 | 2.639016 | 3.031433 | 3.482202 | 4 |

Pexh/Baro

In step 104, the controller 14 is configured to determine an engine intake pressure term, namely, $$\left(\frac{P_{IntMnfd}}{Baro}\right)$$

The controller 14 may determine the intake manifold pressure $P_{IntMnfd}$ by way of a measured reading of the MAP signal 68, and may determine the barometric pressure Baro by way of a measured reading of the barometric pressure signal 52, and then performing the division operation. The method then proceeds to step 106.

In step 106, the controller 14 is configured to determine the new engine pressure ratio of the derated exhaust pressure term $$\left(\frac{P_{ExhMnfd}}{Baro}\right)^a$$

(e.g., value taken from table 82) to the intake pressure term $$\left(\frac{P_{IntMnfd}}{Baro}\right)$$

which may be implemented directly. The method then proceeds to step 108.

In step 108, the controller 14 is configured to determine a volumetric efficiency (VE) value using the now-determined, modified engine pressure ratio. The controller 14 may use conventional methods to compute the VE, such as for example only as set forth in U.S. Pat. No. 6,393,903 entitled VOLUMETRIC EFFICIENCY COMPENSATION FOR DUAL INDEPENDENT CONTINUOUSLY VARIABLE CAM PHASING to Reed et al., assigned to the common assignee of the present invention, and incorporated herein by reference in its entirety. While there are many approaches known in the art for determining VE, in general, VE may be computed from one or more data tables as a function of engine speed and engine pressure ratio, the form of which is set forth in equation (7)

$$VE=f(\text{Engine Speed},Pr) \quad (7)$$

Where Pr will be the new pressure ratio Pr2 according to the invention. Other approaches may be used and remain within the spirit and scope of the present invention. The method then proceeds to step 110.

In step 110, the controller 14, in a preferred embodiment, is configured to use the VE to control the operation of the engine 12. As described above, the VE may be used in calculating mass air flow, which in turn may be used in fueling calculations.

It should be understood that electronic controller 14 as described above may include conventional processing apparatus known in the art, capable of executing pre-programmed instructions stored in an associated memory, all performing in accordance with the functionality described herein. That is, it is contemplated that the processes described herein will be programmed in a preferred embodiment, with the resulting software code being stored in the associated memory. Implementation of the present invention, in software, in view of the foregoing enabling description, would require no more than routine application of programming skills by one of ordinary skill in the art. Such an electronic controller may further be of the type having both ROM, RAM, a combination of non-volatile and volatile (modifiable) memory so that the software can be stored and yet allow storage and processing of dynamically produced data and/or signals.

It is to be understood that the above description is merely exemplary rather than limiting in nature, the invention being limited only by the appended claims. Various modifications and changes may be made thereto by one of ordinary skill in the art, which embody the principles of the invention and fall within the spirit and scope thereof.

The invention claimed is:

1. A method of calculating a volumetric efficiency (VE) for an internal combustion engine having a predetermined air induction configuration, comprising the steps of:

providing a controller in electrical communication with the engine and configured to calculate said VE;

providing an engine exhaust manifold pressure $P_{ExhMnfd}$ to the controller;

calculating a modified engine exhaust manifold pressure with the controller, said modified exhaust manifold pressure being said exhaust manifold pressure $P_{ExhMnfd}$ raised to an exponential power, said exponential power having a value that is associated with the predetermined air induction configuration;

providing an engine intake manifold pressure $P_{IntMnfd}$ to the controller;

calculating an engine pressure ratio with the controller, said engine pressure ratio being the modified exhaust manifold pressure divided by the intake manifold pressure $P_{IntMnfd}$; and calculating said VE using the calculated engine pressure ratio with the controller, wherein the volumetric efficiency is used to control operating performance of the internal combustion engine.

2. The method according to claim 1, wherein the exponential power has a value that is one of, (i) the same as 1.0, and (ii) less than 1.0.

3. The method according to claim 1, wherein the exponential power has a value less than 1.0, whereby a value of the engine pressure ratio reflects the exhaust manifold pressure $P_{ExhMnfd}$ being reduced with respect to the intake manifold pressure $P_{IntMnfd}$.

4. The method according to claim 3, wherein the predetermined air induction configuration comprises an air induction configuration associated with a turbo-charged engine having a parallel waste-gate flow path.

5. The method according to claim 1, wherein the step of providing the exhaust manifold pressure $P_{ExhMnfd}$ further comprises an exhaust manifold pressure term, said exhaust manifold pressure term calculated by the substeps of, providing a barometric pressure to the controller, calculating said exhaust manifold pressure term with the controller by dividing the exhaust manifold pressure $P_{ExhMnfd}$ by the barometric pressure.

6. The method according to claim 1, wherein the step of providing the intake manifold pressure $P_{IntMnfd}$ further comprises an intake manifold pressure term that is calculated by the substeps of, providing a barometric pressure to the controller, calculating said intake manifold pressure term with the controller by dividing the intake manifold pressure $P_{IntMnfd}$ by the barometric pressure.

7. The method according to claim 1, wherein the step of calculating the engine pressure ratio further includes the engine pressure ratio comprising an exhaust manifold pressure term and an intake manifold pressure term, and in which each of the terms, respectively, further is a function of the barometric pressure.

8. The method according to claim 1, wherein the step of providing the controller further includes providing a data table disposed in a memory of the controller, said data table including data values used to control engine operating conditions associated with the engine, and in which said data values are modified exhaust manifold pressure data values and inputs provided to the data table by the controller being the exponential power and one of the exhaust manifold pressure $P_{ExhMnfd}$ and the exhaust manifold pressure $P_{ExhMnfd}$ comprising an exhaust manifold pressure term, and wherein the exhaust manifold pressure term is a function of the exhaust manifold pressure $P_{ExhMnfd}$ divided by a barometric pressure.

9. The method according to claim 1, wherein the internal combustion engine has the predetermined air induction configuration for one of, (i) a naturally aspirated-type engine, (ii) a turbo-charged engine, (iii) a super-charged engine, and (iv) a turbo-charged engine having a parallel waste-gate flow path.

10. The method according to claim 1, wherein the step of calculating the engine pressure ratio further includes, deriving the engine pressure ratio, wherein said ratio is a combination of a back flow from a cylinder in the engine back into an intake manifold of the engine during an intake valve open period $\dot{m}_{Backflow}^{Cyl2Int}$ and a back flow from an exhaust manifold of the engine back into the cylinder $\dot{m}_{BackFlow}^{Exh2Cyl}$.

11. A method of controlling an internal combustion engine having a predetermined air induction configuration using a calculated volumetric efficiency for the engine, comprising:

providing a controller in electrical communication with the engine and configured to generate said calculated volumetric efficiency;

providing an engine exhaust manifold pressure $P_{ExhMnfd}$ to the controller;

calculating a modified engine exhaust manifold pressure with the controller, in which said modified exhaust manifold pressure is said exhaust manifold pressure $P_{ExhMnfd}$ raised to an exponential power, said exponential power having a value is associated with the predetermined air induction configuration;

providing an engine intake manifold pressure $P_{IntMnfd}$ to the controller;

calculating an engine pressure ratio with the controller, said engine pressure ratio being the modified exhaust manifold pressure divided by the intake manifold pressure $P_{IntMnfd}$;

calculating a volumetric efficiency using the calculated engine pressure ratio with the controller; and controlling the internal combustion engine based on said calculated volumetric efficiency.

* * * * *